US011355046B2

(12) United States Patent
Guan

(10) Patent No.: US 11,355,046 B2
(45) Date of Patent: Jun. 7, 2022

(54) GOA CIRCUIT SUPPORTING RANDOM ADDRESSING, DISPLAY DEVICE, AND METHOD FOR CONTROLLING DISPLAY

(71) Applicant: Shenzhen Royole Technologies Co., Ltd., Shenzhen (CN)

(72) Inventor: Ximeng Guan, Shenzhen (CN)

(73) Assignee: Shenzhen Royole Technologies Co., Ltd., Shenzhen (CN)

( * ) Notice: Subject to any disclaimer, the term of this patent is extended or adjusted under 35 U.S.C. 154(b) by 0 days.

(21) Appl. No.: 17/226,714

(22) Filed: Apr. 9, 2021

(65) Prior Publication Data

US 2021/0225243 A1 Jul. 22, 2021

Related U.S. Application Data

(63) Continuation of application No. PCT/CN2018/120046, filed on Dec. 10, 2018.

(51) Int. Cl.
*G09G 3/20* (2006.01)

(52) U.S. Cl.
CPC ..... *G09G 3/20* (2013.01); *G09G 2300/0408* (2013.01); *G09G 2300/0426* (2013.01); *G09G 2300/08* (2013.01); *G09G 2310/0202* (2013.01); *G09G 2310/0267* (2013.01); *G09G 2310/0291* (2013.01); *G09G 2310/06* (2013.01); *G09G 2310/08* (2013.01)

(58) Field of Classification Search
None
See application file for complete search history.

(56) References Cited

U.S. PATENT DOCUMENTS

2002/0000961 A1* 1/2002 Kang ..... G02F 1/13452 345/87
2004/0189572 A1* 9/2004 Nose ..... G09G 3/3677 345/92
2009/0284451 A1* 11/2009 Yamamoto ..... H01L 23/53214 345/77
2014/0050294 A1* 2/2014 Cao ..... G11C 19/28 377/54
2018/0233089 A1* 8/2018 Okamoto ..... G06F 3/0412
2020/0273396 A1* 8/2020 Lu ..... G09G 3/20

FOREIGN PATENT DOCUMENTS

CN 101577102 * 11/2009

* cited by examiner

*Primary Examiner* — Chad M Dicke
(74) *Attorney, Agent, or Firm* — Carter, DeLuca & Farrell LLP; George Likourezos

(57) ABSTRACT

The GOA circuit includes a plurality of GOA units independent of each other, wherein each of the plurality of GOA units comprises an enable module and a drive module disposed corresponding to the enable module; wherein the enable module includes a row address signal input terminal configured to receive a row address signal, and an enable signal output terminal configured to output an enable signal based on the row address signal; and the drive module includes an enable signal input terminal configured to receive the enable signal output by the enable signal output terminal, and a drive signal output terminal configured to output a drive signal based on the enable signal, wherein the drive signal output terminal is connected to a gate line of a row disposed corresponding to the drive module to transmit the drive signal to the gate line of the row and gate the row.

15 Claims, 14 Drawing Sheets

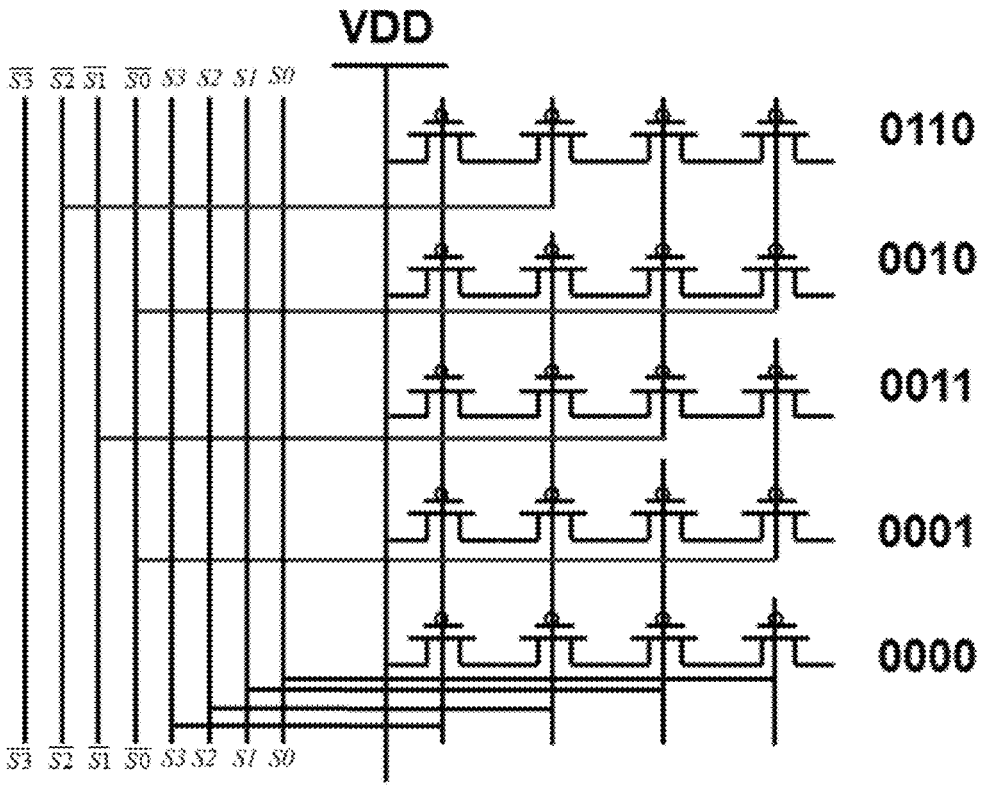
FIG. 5
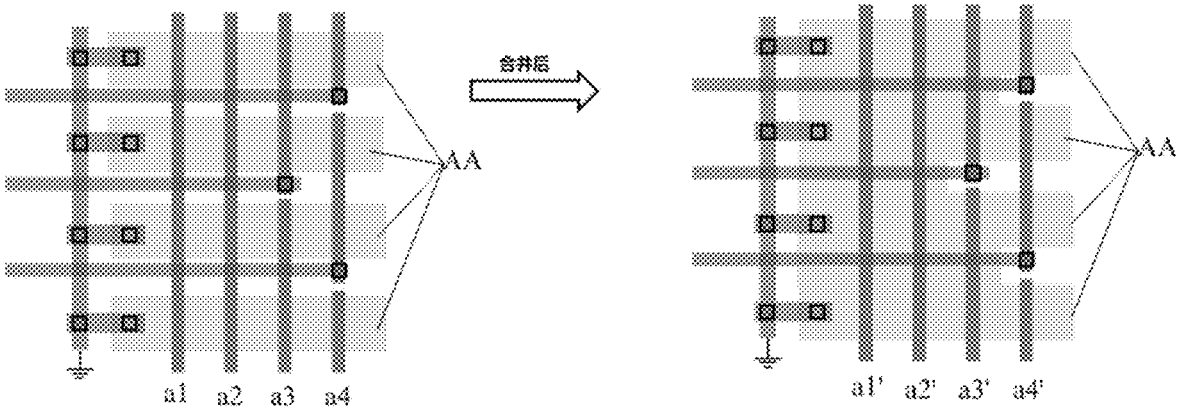
FIG. 6a
FIG. 6b

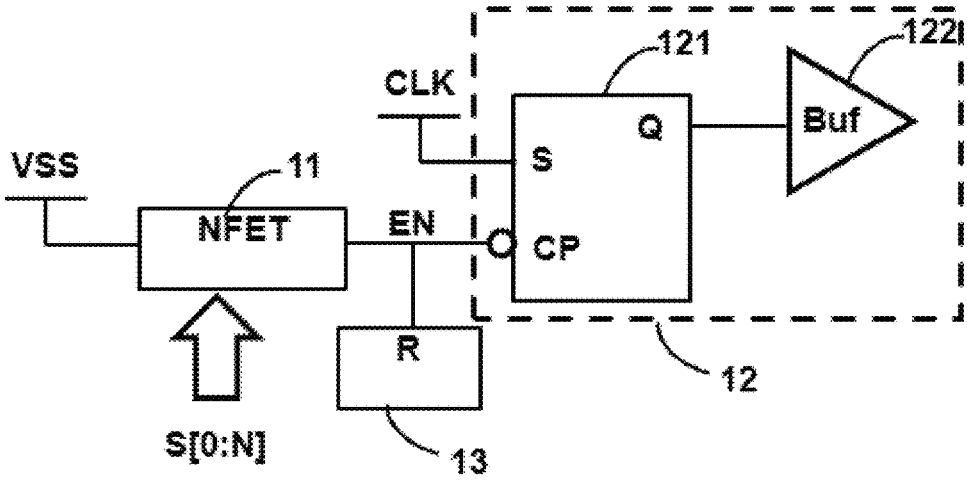
FIG. 13b
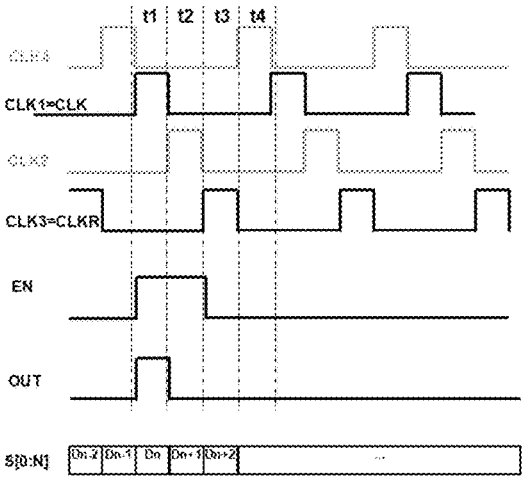
图14b
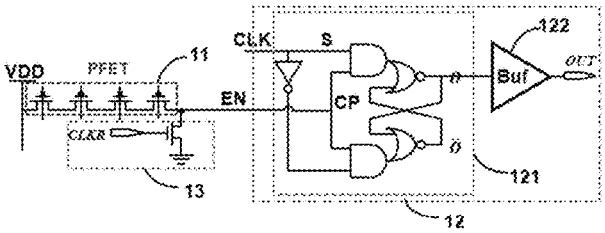
图14a
FIG. 14a FIG. 14b

Scan

Not scan

GOA CIRCUIT SUPPORTING RANDOM ADDRESSING, DISPLAY DEVICE, AND METHOD FOR CONTROLLING DISPLAY

TECHNICAL FIELD

The present disclosure relates to the technical field of display panels, and in particular, relates to a GOA circuit, a display device, and a method for controlling a display.

BACKGROUND

Gate driver on array (GOA) circuits are widely applied in LCDs, AMOLEDs, and the like electronic display devices. The GOA circuit is a key part of a display panel, and is configured to supply a scanning pulse signal to a pixel array.

The traditional GOA circuit is based on the basic design that a previous stage triggers a following stage, and is generally constituted by a bootstrap capacitor and a single-polarity transistor. Based on this design, the pixel array may only be orderly scanned, but may not be randomly scanned.

When the screen includes n rows of pixels, these pixels are scanned row by row with a refresh frequency of 60 Hz, and a time of 1/60/N is assigned to each row. A capacitive load of a clock line for driving the GOA is proportional to $C_{gon}+C_{ov}*(N-1)+C_{pixel}$. $C_{gon}$ represents a load contribution of an activated GOA to the clock line, $C_{ov}$ represents a load contribution of the remaining N−1 stages of GOAs to the clock line, and $C_{pixel}$ represents a load contribution of all the pixels in a row being scanned. When the size of an output transistor of the GOA increases, $C_{gon}$ and $C_{ov}$ may both increase proportionally.

When the size of the screen constantly increases, the resolution constantly increases, and the pixel density constantly increases, more and more challenges are caused to the GOA circuit as follows:

The number of pixels in each row increases, and the load ($C_{pixel}$) of the GOA circuit increases.

The size of the pixels in each row decreases, the available area for the GOA circuit cooperated with the pixels constantly decreases, the size of the transistors for fabricating the GOA circuit is further restricted, and thus the drive capability is degraded.

The increase of the absolute number of rows causes the scanning time for each row to constantly decrease (1/60/N). To accommodate more stricter timing requirements, the size of the output transistors of the GOA circuit needs to be increased. This requirement is not only in contradiction with the decrease of the area, but also causes $C_{gon}$ and $C_{ov}$ to constantly increase.

The increase of the absolute number of rows causes the number of stages (N−1) of the GOA units in a turn-off state to constantly increase, causes the load of the clock lines to correspondingly increase, and cause useless power to increase.

The increase of the absolute number of rows increases the probability that the GOA circuit becomes defective. Once a stage of GOA unit fails, the following stages of GOA units may fail, and consequently, the screen may be damaged.

Due to the above factors, when the traditional GOA circuit structure is applied to screens with constantly increasing size, resolution and pixel density, more and more severe challenges occur, the timing fails to be accommodated, the power consumption constantly increases, and the yield constantly decreases.

SUMMARY

The present disclosure provides a GOA circuit. The GOA circuit includes a plurality of GOA units independent of each other, wherein each of the plurality of GOA units includes an enable module and a drive module disposed corresponding to the enable module; wherein the enable module includes a row address signal input terminal configured to receive a row address signal, and an enable signal output terminal configured to output an enable signal based on the row address signal; and the drive module includes an enable signal input terminal configured to receive the enable signal output by the enable signal output terminal, and a drive signal output terminal configured to output a drive signal based on the enable signal, wherein the drive signal output terminal is connected to a gate line of a row disposed corresponding to the drive module to transmit the drive signal to the gate line of the row and gate the row.

The present disclosure further provides a display device. The display device includes the GOA circuit as described above.

The present disclosure further provides a method for controlling a display. The method includes:

inputting an address signal to each of row decoders in a GOA circuit of the display;

enabling a row decoder corresponding to the address signal;

outputting an enable signal to a drive module of the GOA circuit of the display via the enabled row decoder; and driving, by the drive module receiving the enable signal, pixels in a corresponding row to operate.

BRIEF DESCRIPTION OF THE DRAWINGS

The present disclosure is further described with reference to the accompanying drawings and exemplary embodiments. Among the drawings:

FIG. 5 is a circuit principle diagram of a row decoder practiced by a P-type transistor according to the present disclosure;

FIG. 6*a* schematically illustrates a layout design diagram of a row decoder practiced by N-type transistors (transistors are not combined), FIG. 6*b* schematically illustrates a layout design diagram of a row decoder with transistors combined based on a preset condition according to the present disclosure.

FIG. 13*b* is a circuit principle diagram of a single GOA unit employing an N-type transistor as a decoder;

FIG. 14*a* is a circuit principle diagram of a reset module employing a single GOA unit according to the first embodiment, and FIG. 14*b* is an operating timing of a single stage of GOA unit employing the circuit in FIG. 14*a;*

DETAILED DESCRIPTION

For clearer descriptions of the technical features, objectives, and the technical effects of the present disclosure, the specific embodiments of the present disclosure are hereinafter described with reference to the accompanying drawings.

Figure 1:
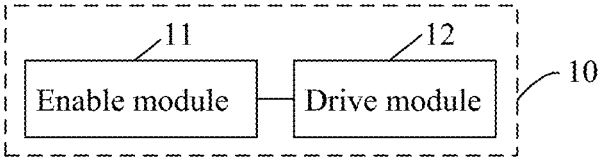
FIG. 1 is a schematic structural view of a single GOA unit in a GOA circuit according to a first embodiment of the present disclosure.

Referring to FIG. 1, a schematic structural diagram of a GOA circuit according to a first embodiment of the present disclosure is illustrated.

As illustrated in FIG. 1, the GOA circuit according to this embodiment includes a plurality of GOA units 10 independent of each other, wherein each of the plurality of GOA units includes an enable module 11 and a drive module 12 disposed corresponding to the enable module 11. The GOA circuit according to the present disclosure is based on polarity complementary transistors. That is, an N-type transistor and a P-type transistor are simultaneously disposed on a panel.

The enable module 11 includes a row address signal input terminal configured to receive a row address signal, and an enable signal output terminal configured to output an enable signal based on the row address signal.

Herein, it should be noted that the present disclosure does not limit the source of the row address signal. In some embodiments, the row address signal may be generated by an external drive IC. However, in some other embodiments, the row address signal may also be generated by a display screen. For example, when the display screen is capable of providing two types of polarity complementary transistors, a dedicated circuit is designed on the display screen. The dedicated circuit is capable of directly generating the row address signal, and thus the row address signal does not need to be supplied by the external drive IC.

Optionally, the enable module 11 according to the embodiment of the present disclosure is a row decoder based on binary coding, or a row decoder based on Gray coding. Each row decoder includes a plurality of transistors connected in series, wherein two transistors in adjacent rows and in a same column are combined to a transistor when satisfying a preset condition.

By using the row decoder according to the embodiment of the present disclosure, random addressing may be implemented, data is allowed to be written into the screen not in a row order, and later-stage trigger is not dependent on previous-stage trigger, which effectively improves yield and grade of the screen, and provides possibilities to dynamically repair the screen. In addition, by using the row decoder based on Gray coding, transverse cross lines in the layout may be reduced, more transistors are allowed to be combined, and thus dynamic power consumption of the decoder is reduced in the mostly commonly used sequential scanning.

Hereinafter, a comparison is made between the row decoder based on sequential coding and the row decoder according to the present disclosure in terms of design.

Figure 3:
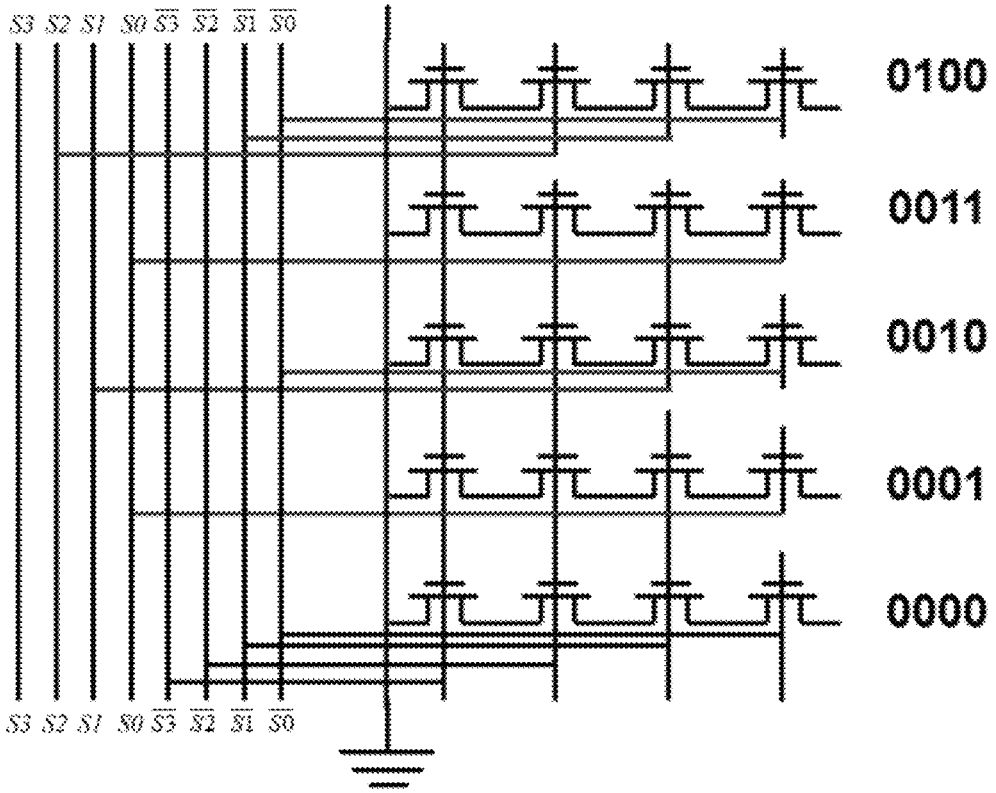
FIG. 3 is a circuit principle diagram of a decoder based on sequential coding.

As illustrated in FIG. 3, a circuit principle diagram of a row decoder based on sequential coding is illustrated. The row decoder takes a 4-bit 16-stage GOA as an example. If the row decoder is designed based on sequential coding, then a $0^{th}$-stage code is 0000, a first-stage code is 0001, . . . , a fifteenth-stage code is 1111, which are listed in Table 1.

TABLE 1

| Stage | Code | Row address signal |
|---|---|---|
| 0 | 0000 | $\overline{S3}\overline{S2}\overline{S1}\overline{S0}$ |
| 1 | 0001 | $\overline{S3}\overline{S2}\overline{S1}S0$ |
| 2 | 0010 | $\overline{S3}\overline{S2}S1\overline{S0}$ |
| 3 | 0011 | $\overline{S3}\overline{S2}S1S0$ |
| 4 | 0100 | $\overline{S3}S2\overline{S1}\overline{S0}$ |
| 5 | 0101 | $\overline{S3}S2\overline{S1}S0$ |
| 6 | 0110 | $\overline{S3}S2S1\overline{S0}$ |
| 7 | 0111 | $\overline{S3}S2S1S0$ |

As seen from FIG. 3, a plurality of transverse cross lines are present in a decoder based on sequential coding, and each row requires a different number of transverse cross lines. With respect to a 2N-stage decoder, in a worst condition, between a $2^{N-1}-1$ stage and a $2^{N-1}$ stage, the number of required transverse cross lines reaches (N−1). Due to a large number of transverse cross lines, some impacts are inevitably caused to the screen. For example, the row height is occupied, and the increase of the pixels per inch (PPI) is restricted; the mutual inductance between connecting lines is increased, signal crosstalk is caused and the load of the connecting lines is increased, and the dynamic power consumption and the delay are increased; and repair is inconvenient and it is difficult to improve the yield.

Figure 4:
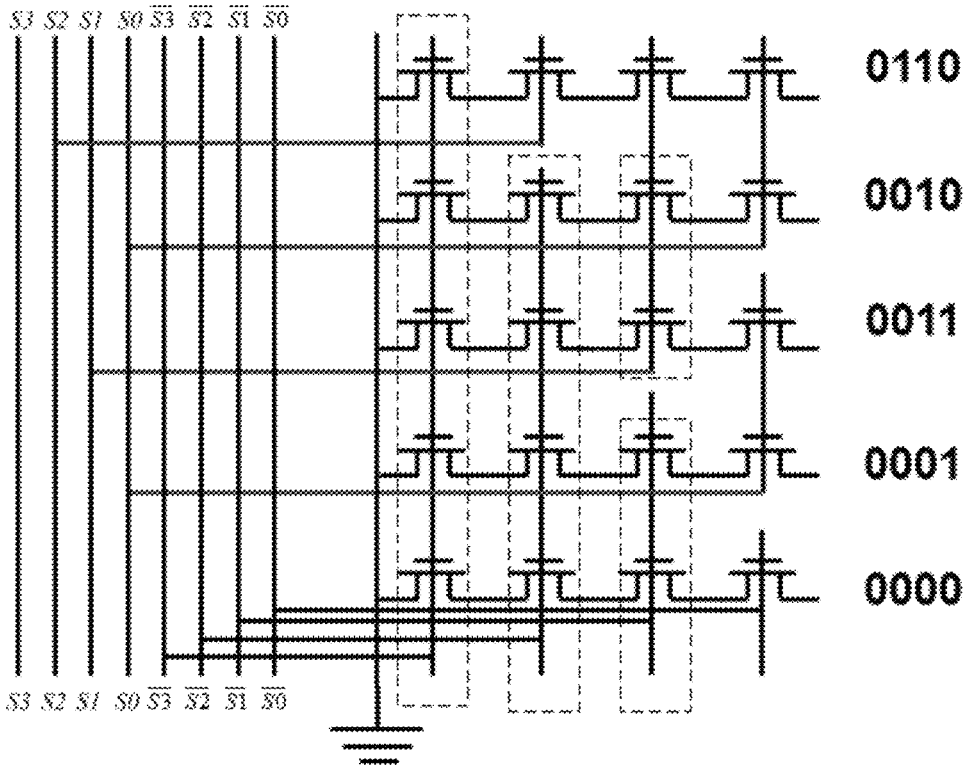
FIG. 4 is a circuit principle diagram of a row decoder practiced by an N-type transistor according to the present disclosure.

With respect to the row decoder based on Gray coding according to the present disclosure, as known from the characteristic of Gray coding, two adjacent codes have only one different bit. Therefore, each row decoder according to the present disclosure only needs one transverse cross line. This characteristic is irrelevant to the resolution of the screen. That is, regardless of whether FHD or 4K UHD, when the GOA row decoder according to the present disclosure is employed, only one transverse cross line is needed in each row. A circuit principle diagram of the row decoder based on Gray coding according to a specific embodiment of the present disclosure is as illustrated in FIG. 4. The row decoder according to this embodiment takes a 4-bit 16-stage GOA as an example, and in this example, a first-stage code is 0010, a second-stage code is 0011, a third-stage code is 0010, . . . , a fifteenth-stage code is 1000, which are listed in Table 2.

TABLE 2

| Stage | Code | Row address signal |
|---|---|---|
| 0 | 0000 | $\overline{S3}\overline{S2}\overline{S1}\overline{S0}$ |
| 1 | 0001 | $\overline{S3}\overline{S2}\overline{S1}S0$ |
| 2 | 0010 | $\overline{S3}\overline{S2}S1S0$ |
| 3 | 0011 | $\overline{S3}\overline{S2}S1\overline{S0}$ |
| 4 | 0100 | $\overline{S3}S2S1\overline{S0}$ |
| 5 | 0101 | $\overline{S3}S2S1S0$ |
| 6 | 0110 | $\overline{S3}S2\overline{S1}S0$ |
| 7 | 0111 | $\overline{S3}S2\overline{S1}\overline{S0}$ |

It is herein to be noted that in the principle diagrams in FIG. 3 and FIG. 4, the transistor is an N-type transistor and has only 16 stages and 4 address bits. However, the application scope of the present disclosure shall include cases of N-type and P-type transistors and any number of stages. In addition, in FIG. 3 and FIG. 4, the symbol of the transistor only indicates that a transistor is needed there, instead of indicating the number of transistors there. Particularly, in the principle diagram in FIG. 4, if two transistors in the adjacent rows and in the same column satisfy the preset condition, the two transistors may be combined into one transistor. That is, two transistors in the adjacent rows and in the same column may be combined to a transistor having a larger size and a powerful drive capability if satisfying the preset condition.

The fact that two transistors in the adjacent rows and in the same column satisfy the preset condition includes: the gates of the two transistors being shorted together, and each of the two transistors being an uppermost transistor in the row decoder; or gates of the two transistors being shorted together, and upper transistors adjacent to the two transistors having been combined. Nevertheless, the row decoder according to the present disclosure may also be practiced by a P-type transistor, wherein the practice of the P-type transistor is similar to that of the N-type transistor, and the difference lies in that code 0 corresponds to a positive signal, and code 1 corresponds to a negative signal, and a voltage polarity of the P-type transistor is symmetric to that of the N-type transistor. Specifically, the circuit principle diagram of the row decoder practiced by the P-type transistor is as illustrated in FIG. 5, and the specific code is as listed in Table 3.

TABLE 3

| Stage | Code | Row address signal |
|---|---|---|
| 0 | 0000 | S3S2S1S0 |
| 1 | 0001 | S3S2 S1$\overline{S0}$ |
| 2 | 0010 | S3S2$\overline{S1}\overline{S0}$ |
| 3 | 0011 | S3S2$\overline{S1}$S0 |
| 4 | 0100 | S3$\overline{S2}\overline{S1}$S0 |
| 5 | 0101 | S3$\overline{S2}$S1$\overline{S0}$ |
| 6 | 0110 | S3$\overline{S2}$S1$\overline{S0}$ |
| 7 | 0111 | S3S2$\overline{S1}$S0 |

Likewise, the condition of combination of the transistors in the row decoder practiced by the P-type transistor is the same as that in the row decoder practiced by the N-type transistor, which is not described herein any further.

Further, as illustrated in FIG. 6*b*, a layout design of the row decoder practiced by the N-type transistor according to the present disclosure is illustrated. According to the present disclosure, the row decoder is practiced by connecting in series of the transistors as described above, such that the layout of the row decoder is very compact, thereby saving the area and shortening the delay.

Specifically, as illustrated in FIG. 6*b*, the transistors in the same row are connected in series, and thus sources and drains of the adjacent transistors in the same row may be shared, with no need of connection via metals and contact holes. This design scheme not only saves the transverse area, but also effectively prevents the impacts caused by contact resistance and load capacitance caused by metal connecting lines.

FIG. 6*a* schematically illustrates the layout of the transistors that are not combined, and FIG. 6*b* schematically illustrates the layout of the transistors that are combined.

Figure 6C:
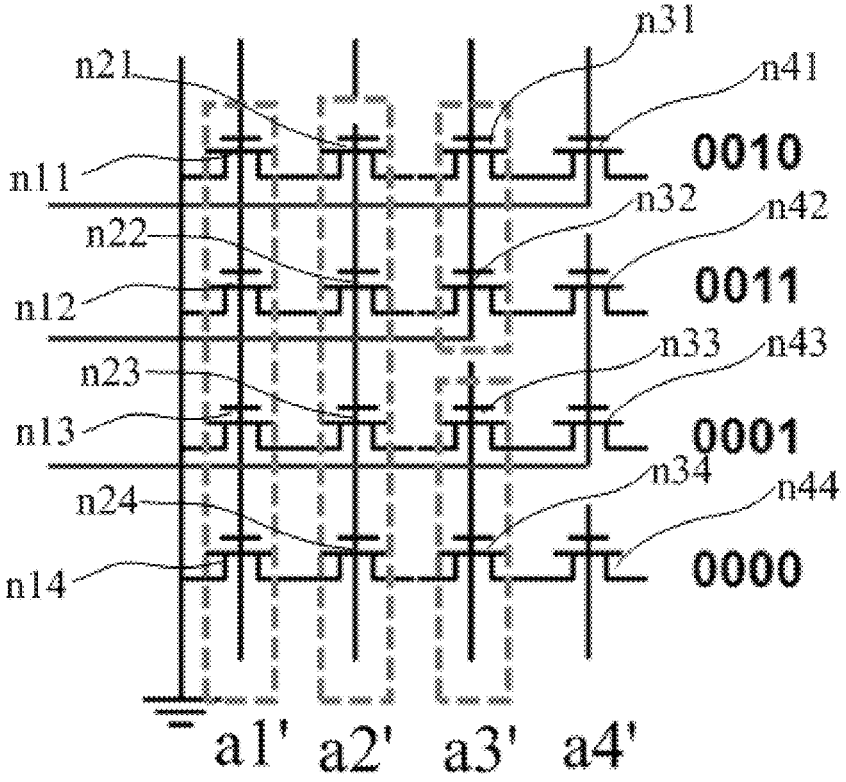
FIG. 6*c* is a circuit principle diagram of FIG. 6*b;*

As illustrated in FIG. 6*a* to FIG. 6*c*, with respect to transistors (n11 to n14) in a leftmost first column (a1), according to the preset condition, since gates of these transistors are shorted together, and each of these transistors is an uppermost transistor in the corresponding row, the transistors (n11 to n14) in the leftmost first column (a1) may be combined, and the layout after the combination of these transistors is as illustrated in a leftmost first column (a1') in FIG. 6*b*. Then, with respect to transistors in a second column (a2) from the left in FIG. 6*a*, since gates of these transistors are shorted together, and upper adjacent transistors of these transistors, that is, the transistors (n11 to n14) in the leftmost first column (a1), have been combined. Therefore, according to the preset condition, transistors (n21 to n24) in the second column (a2) from the left may also be combined, and the layout after the combination of these transistors is as illustrated in a second column (a2') from the left in FIG. 6*b*. Afterwards, with respect to transistors in a third column (a3) from the left in FIG. 6*a*, since gates of these transistors are not all shorted together (as illustrated in FIG. 6*c*, the gate of a transistor n31 is shorted to the gate of a transistor n32, the gate of a transistor n33 is shorted to the gate of a transistor n34, but the gate of the transistor n32 is not shorted to the gate of the transistor n33), four transistors (n31 to n34) in this column may not totally combined. However, the gates of two upper transistors (the transistor n31 and the transistor n32) are respectively shorted to the gates of two lower transistors (the transistor n33 and the transistor n34), and upper transistors, that is, the transistors (n21 to n24) in the second column (a2) from the left, of these transistors have been combined. Therefore, according to the preset condition, the two upper adjacent transistors (the transistor n31 and the transistor n32) may be respectively combined with the two lower transistors (the transistor n33 and the transistor n34), and the layout after the combination of these transistors is as illustrated in a third column (a3') from the left in FIG. 6*b*. Finally, with respect to a lowest column (a4), among four transistors (n41 to n44), gates of only two middle transistors (a transistor n42 and a transistor n43) may be shorted together. However, upper adjacent transistors (the transistor n32 and the transistor n33) of these two middle transistors (the transistor n42 and the transistor n43) have not combined. Therefore, these four transistors (n41 to n44) do not satisfy the preset condition and thus may not be combined. Accordingly, among the four transistors (n41 to n44) in the lowest column (a4), no two transistors may be combined, and thus the layout after the combination of the row decoder is as illustrated in FIG. 6*b*. The circuit principle diagram of FIG. 6*b* is as illustrated in FIG. 6*c*. In FIG. 6*c*, the transistors in the dotted-line block are combined.

It should be noted herein that the combination may be interpreted as that active regions of the transistors originally pertaining to different rows may be fused in the layout (as illustrated in a gray region (AA) in FIG. 6). Through the fusion, a width of the active regions may be increased, that is, the width of the transistors is increased, and thus a higher drive current (or equivalently, an even lower turn-on resistance) may be acquired. In addition, edges of mutually separated active regions need to satisfy a design rule of a minimum process spacing, and this rule does not need to be considered upon the fusion. In this way, requirements on mask fabrication and photolithography are both lowered, and yield of the process is greatly improved.

Further description is given hereinafter to advantages of the combined row decoder with reference to FIG. 7*a* and FIG. 7*b*.

Figure 7A:
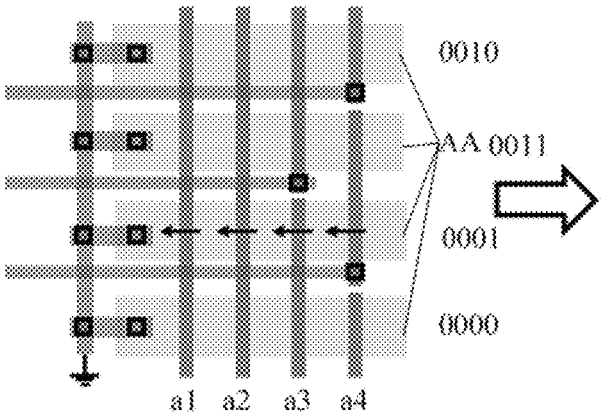
FIG. 7*a* schematically illustrates a current flow of a row decoder practiced by N-type transistors (transistors are not combined), and FIG. 7*b* schematically illustrates a current flow of a row decoder with transistors combined based on a preset condition according to the present disclosure.
Figure 7B:
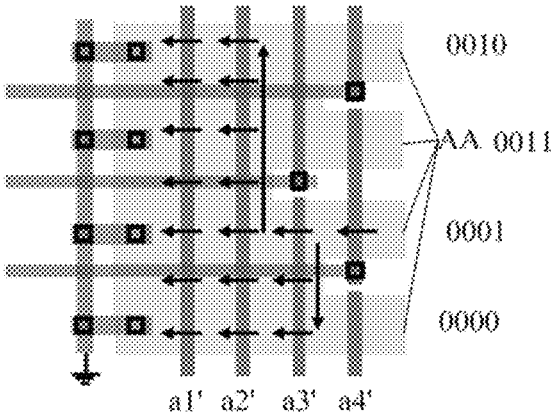

As illustrated in FIG. 7*a*, the case where row 0001 is selected is considered. Where no combination is made, the current may only flow through four TFTs connected in series in this row. When a combination is made, the current, when flowing towards the upper transistors, may be quickly dispersed into a wider path (as illustrated in FIG. 7*b*). Since the resistance is in negative proportion to the width of the current path, and the upper the transistors the current flows to, the smaller the resistance, a total resistance discharging the enable terminal is smaller than that in the case of no combination, that is, the decoding speed is higher.

Assuming that an effective resistance after a single transistor is turned on is R in the case of no combination, then an affective resistance after two transistors are combined is lowered to R/2. Therefore, in the case of no combination, a total discharging resistance of each row is 4*R; and in the case of a combination, the total discharging resistance is R*(1+1/2+1/4+1/8)<2*R (geometrical series). In consideration of a screen having 4096 rows, a 14-bit address is desired, and 14 transistors need to be connected in series. In the case of no combination, a total resistance is 14*R; and in the case of a combination, the total resistance is R*(1+1/2+1/4+1/8++1/4096)<2*R. according to the characteristics of the geometrical series, the total discharging resistance upon the combination may not proportionally increase with increase of the number of resolution rows, but an upper limit is defined. Therefore, discharging time, that is, decoding time, is not affected by the increase of the resolution upon the combination. Therefore, with the combination, the row decoder is capable of supporting a high-resolution screen, such that the decoding speed is substantially irrelevant to the increased address line.

The drive module 12 includes an enable signal input terminal connected to the enable signal output terminal and configured to receive the enable signal output by the enable signal output terminal, and a drive signal output terminal configured to output a drive signal based on the enable signal, wherein the drive signal output terminal is connected to a gate line of a row disposed corresponding to the drive module 12 to transmit the drive signal to the gate line of the row and gate the row.

Optionally, the drive signal output by the drive module 12 is a pulse signal. The drive module 12 may be a pulse generator.

As a solution, the present disclosure provides a GOA circuit supporting random addressing. The GOA circuit allows data to be written into the screen not in accordance with rows. A majority region of the screen displays static images and only a small portion of the screen is constantly varying, and only this portion needs to be programmed. In addition, since the rows with static images are not gated, and thus dynamic power consumption is effectively reduced and meanwhile the time left for each row with varying images, such that real-time and dynamic adjustment may be achieved between display size, display power and display refresh rate.

Further, in the GOA circuit according to the present disclosure, trigger of a later stage does not rely on trigger of a previous stage. Therefore, when a separated-stage GOA unit 10 fails, functions of the remaining GOA units 10 are not affected, such that yield and rating of the screen are improved, thereby providing possibilities of dynamic repair of the screen. In addition, the GOA circuit according to the present disclosure does not employ a traditional bootstrap structure. A clock line does not need to directly drive an output transistor in the GOA unit 10. Therefore, impacts caused by (N−1) stages of inactive GOA units 10 to the dynamic power consumption may be greatly mitigated.

Therefore, the GOA circuit according to the present disclosure is applicable to high resolution and large-size screens.

Figure 2:
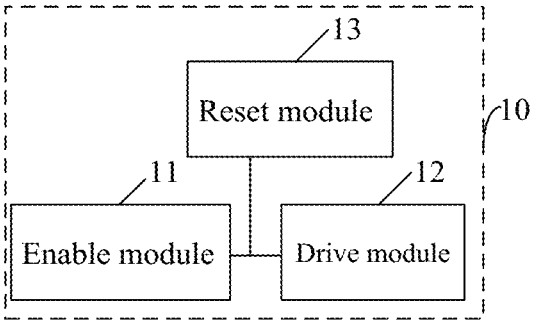
FIG. 2 is a schematic structural diagram of a single GOA unit in a GOA circuit according to a second embodiment of the present disclosure.

FIG. 2 is a schematic structural diagram of a GOA circuit according to a second embodiment of the present disclosure.

According to this embodiment, based on the first embodiment, each of the plurality of GOA units 10 further comprises a reset module 13 connected to the enable signal output terminal of the enable module 11 and configured to reset the enable module 11 in response to the drive module 12 outputting the drive signal and gating the corresponding row.

Optionally, one or a plurality of reset modules 13 may be configured. When a plurality of reset modules 13 are configured, each of the plurality of reset modules 13 is disposed corresponding to each row decoder.

After any row decoder of the row decoders outputs an enable signal, and causes the drive module 12 to output a drive signal, the reset modules 13 in this row are all reset, such that a row to which the drive signal is output is reselected when a next row address signal comes in.

Specifically, if the enable signal output by the enable module 11 is a high level (1), the reset module 13 may reset the enable signal to a low level (0); and if the enable signal output by the enable module 11 is the low level (0), the reset module 13 resets the enable signal to the high level (1).

Figure 8:
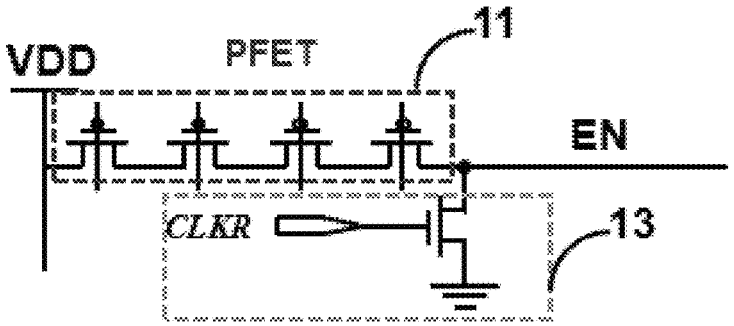
FIG. 8 is a circuit principle diagram of a reset module according to the first embodiment of the present disclosure.

FIG. 8 is a circuit principle diagram of the reset module 13 according to the first embodiment of the present disclosure. This embodiment is based on any row of the row decoder constituted by P-type transistors and the reset module 13 corresponding to this row.

As illustrated in FIG. 8, the reset module 13 may include a reset transistor.

A first electrode of the reset transistor is connected to the enable signal output terminal of the enable module 11, a second electrode of the reset transistor is connected to a ground signal (GND), and a gate of the reset transistor is connected to a first clock signal (CLKR). It should be noted herein that the first clock signal (CLKR) is an additional external clock signal. Further, this embodiment describes the row decoder constituted by the P-type transistors, and when the row decoder is constituted by the N-type transistors, the polarity is reverse to that of the row decoder constituted by the P-type transistors, which is not described herein any further.

FIG. 8 Exemplarily illustrates a row decoder constituted by the P-type transistors and a high level output by decoder.

As illustrated in FIG. 8, when a high pulse of the first clock signal (CLKR) comes in, the reset transistor is turned on, the output terminal of the row decoder is pulled down to a low level, and the output terminal of the row decoder is reset to the low level.

Figure 9:
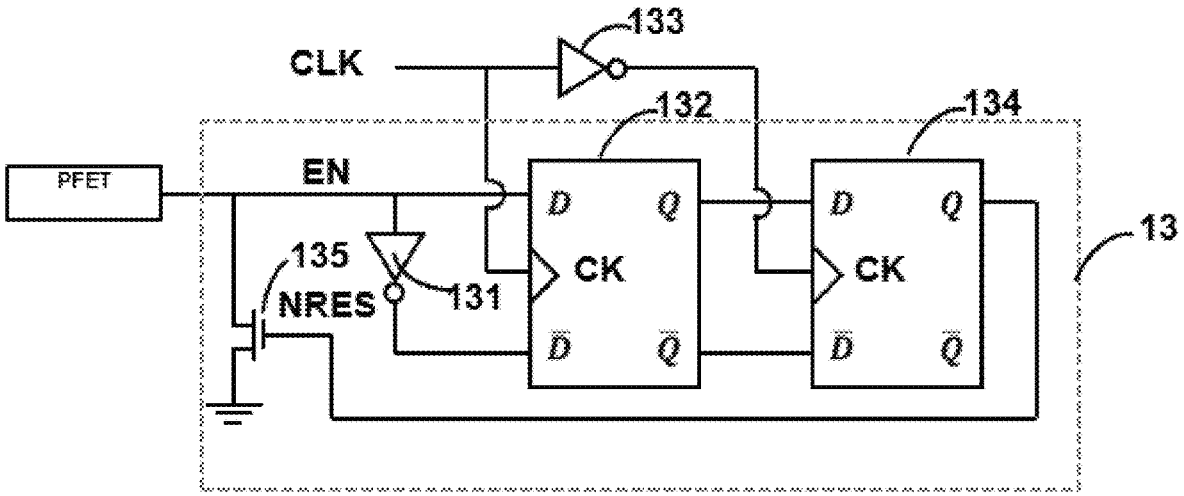
FIG. 9 is a circuit principle diagram of a reset module according to the second embodiment of the present disclosure.

FIG. 9 is a circuit principle diagram of a reset module 13 according to the second embodiment of the present disclosure. This embodiment is based on any row of the row decoder constituted by P-type transistors and the reset module 13 corresponding to this row.

As illustrated in FIG. 9, the reset module 13 includes a pull-down transistor 135, a first-stage positive edge flip-flop 132, a first-stage inverter 131, a second-stage positive edge flip-flop 134, and a second-stage inverter 133.

Anon-inverting input terminal (D) of the first-stage positive edge flip-flop 132 and an input terminal of the first-stage inverter 131 are collectively connected to the enable signal output terminal of the enable module 11, an inverting input terminal of the first-stage positive edge flip-flop 132 is connected to an output terminal of the first-stage inverter 131, and a signal clock signal input terminal (CK) of the first-stage positive edge flip-flop 132 and an input terminal of the second-stage inverter 133 are collectively connected to a second clock signal (CLK). A non-inverting input terminal (D) of the second-stage positive edge flip-flop 134 is connected to a non-inverting output terminal (Q) of the first-stage positive edge flip-flop 132, an inverting input terminal of the second-stage positive edge flip-flop 134 is connected to an inverting output terminal of the first-stage positive edge flip-flop 132, a clock signal input terminal of the second-stage positive edge flip-flop 134 is connected to an output terminal of the second-stage inverter 133, and a non-inverting output terminal (Q) of the second-stage positive edge flip-flop 134 is connected to a gate of the pull-down transistor 135. A first electrode of the pull-down transistor 135 is connected to the enable signal output terminal of the enable module 11, and a second electrode of the pull-down transistor 135 is connected to a ground signal (GND).

In this embodiment, the reset module 13 does not need to additionally reset the clock, and shares the same clock (CLK) and an inverting signal thereof with a latch at this stage. That is, the CLK in this embodiment is a CLK shared with the latch at this stage.

As illustrated in FIG. 9, the reset module 13 according to this embodiment is constituted by two stages of cascaded positive edge flip-flops and inverters. The positive edge flip-flop is one of fundamental circuits in a digital logic circuit, and basically achieves the function of: storing a signal of the input terminal (D) only at a rising edge of an input clock and transmitting the signal to the output terminal (Q), and maintaining a signal of the output terminal (Q) unchanged at other times regardless of how the input terminal (D) changes. Based on this principle, the reset module 13 according to this embodiment operates based on the following principle: When the EN is selected and a high level is output, the high level is latched at the rising edge of the CLK, and transmitting the high level to the gate (NRES terminal) of the pull-down transistor 135 at a next falling edge of the CLK, the pull-down transistor 135 is turned on, and the EN is reset to a low level; and when the EN is not selected and a low level is output, the flip-flop has no output, the gate (NRES terminal) of the pull-down transistor 135 is constantly the low level, the pull-down transistor 135 is turned off, and the level of the EN is not affected.

In the embodiments of the present disclosure, the positive edge flip-flop may be practiced in a plurality of ways, which is not specifically limited in the present disclosure. Description is given with reference to a specific embodiment. Specifically, as illustrated in FIG. 10, in this embodiment, the applied positive edge flip-flop may be a primary/secondary flip-flop, which may be constituted by two stages of latches.

Figure 10:
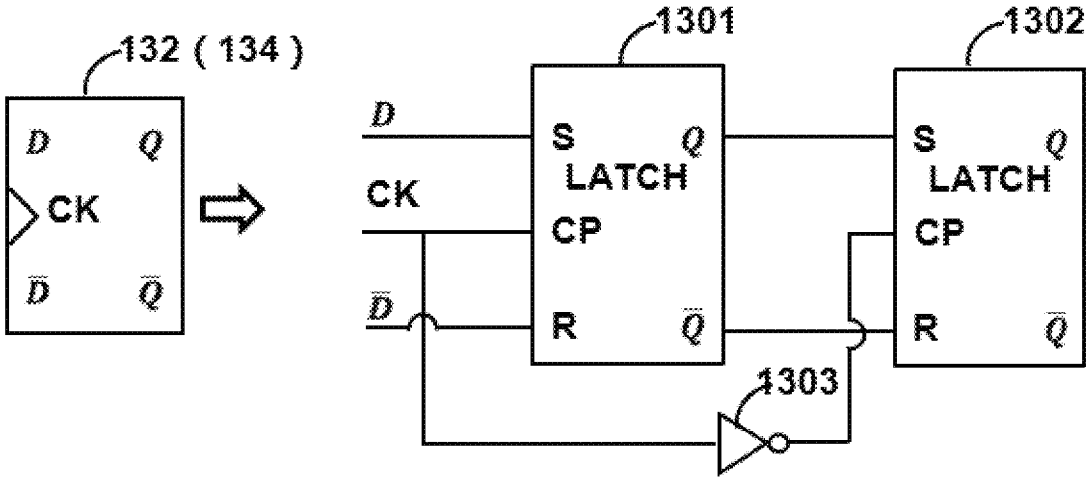
FIG. 10 is a schematic structural view of a positive edge flip-flop according to an embodiment of the present disclosure.

As illustrated in FIG. 10, the first-stage positive edge flip-flop 132 and the second-stage positive edge flip-flop 134 both include a primary flip-flop 1301, a secondary flip-flop 1302, and a primary/secondary inverter 1303.

An input terminal (S) of the primary flip-flop 1301 is a non-inverting input terminal (D) of the positive edge flip-flop, a non-inverting output terminal of the primary flip-flop 1301 is connected to an input terminal (S) of the secondary flip-flop, a reset terminal (R) of the primary flip-flop is an inverting input terminal of the positive edge flip-flop, and an inverting output terminal of the primary flip-flop 1301 is connected to a reset terminal (R) of the secondary flip-flop 1302. A non-inverting output terminal (Q) of the secondary flip-flop 1302 is a non-inverting output terminal (Q) of the positive edge flip-flop, a clock signal input terminal (CP) of the secondary flip-flop 1302 travels through an output terminal of the primary/secondary inverter 1303, and a connecting terminal between an input terminal of the primary/secondary inverter 1303 and a clock signal input terminal (CP) of the primary flip-flop 1301 is a clock signal input terminal (CK) of the positive edge flip-flop.

Further, the drive module 12 according to the embodiment of the present disclosure may include a latch circuit 121 and a buffer amplifier circuit 122. A first terminal of the latch circuit 121 is connected to a second clock signal (CLK), a second terminal of the latch circuit 121 is connected to the enable signal output terminal of the enable module 11, a third terminal of the latch circuit 121 is connected to an input terminal of the buffer amplifier circuit 122, and an output terminal of the buffer amplifier circuit 122, as the drive signal output terminal of the drive module 12, is connected to a gate line of a row disposed corresponding to the drive module 12.

Further, the drive module 12 according to the embodiment of the present disclosure may further include a buffer amplifier circuit 122. An output terminal of the latch circuit 121 is not directly connected to the gate line of a row disposed corresponding to the drive module 12, but is first connected to the input terminal of the buffer amplifier circuit 122 and is then connected to the gate line of the row disposed corresponding to the drive module 12 as the drive signal output terminal of the drive module 12.

Further, in the embodiment of the present disclosure, the latch circuit 121 may include a latch, and the buffer amplifier circuit 122 may be constituted by one stage of inverter or a plurality of stages of cascaded inverters.

In a specific embodiment, if the buffer amplifier circuit 122 is constituted by one stage of inverter, the latch circuit 121 is constituted by a latch, an input terminal (S) of the latch is connected to the second clock signal (CLK), an enable terminal (CP) of the latch is connected to the enable signal output terminal of the enable module 11, an output terminal (Q) of the latch is connected to an input terminal of the one stage of inverter, and an output terminal of the one stage of inverter is connected to the gate line of the row disposed corresponding to the drive module 12. The input terminal (S) of the latch is a data input terminal of the latch circuit 121, and the enable terminal (CP) of the latch is a clock input terminal of the latch circuit 121, and the output terminal (Q) of the latch is the output terminal of the latch circuit 121. The input terminal of the one stage of inverter is the input terminal of the buffer amplifier circuit 122, and the output terminal of the one stage of inverter is the output terminal of the buffer amplifier circuit 122.

Further, in another specific embodiment, if the buffer amplifier circuit 122 is constituted by a plurality of stages of cascaded inverters, the latch circuit 121 is constituted by a latch, assuming that n stages of cascaded inverters are configured, n being an integer greater than or equal to 2, then the input terminal (S) of the latch is connected to the second clock signal (CLK), the enable terminal (CP) of the latch is connected to the enable signal output terminal of the enable module 11, the output terminal (Q) of the latch is connected to an input terminal of a first-stage inverter, and an output terminal of an nth-stage inverter is connected to the gate line of the row disposed corresponding to the drive module 12. The input terminal (S) of the latch is the data input terminal of the latch circuit 121, the enable terminal (CP) of the latch is the clock input terminal of the latch circuit 121, the output terminal (Q) of the latch is the output terminal of the latch circuit 121. The input terminal of the first-stage inverter is the input terminal of the buffer amplifier circuit 122, and the output terminal of the nth-stage inverter is the output terminal of the buffer amplifier circuit 122.

Herein, the latches employed in the embodiment of the present application are all latches with a gate control function, which operate based on the following principle.

using latches effective in case of a high level at the enable terminal (CP) as an example:

When the CP potential is a low level, the output terminal Q remains unchanged, and the signal of the input terminal S does not affect the output terminal Q.

When the CP potential is a high level, a binary signal of the output terminal Q varies with variation of an input potential of the input terminal S. It may be understood that the latch may be practiced in a plurality of ways, which is not specifically limited in the embodiments of the present disclosure. By employing the latch in each of the plurality of GOA units 10, the present disclosure may achieve the following advantages: Based on the latching principle, internal alternating current signals or glitch signals may be effectively suppressed from being coupled to the output terminal; and in addition, the latch has a waveform reconstruction function, and even if a waveform of an external clock is deformed due to an RC delay, upon the waveform reconstruction, a high-quality square wave pulse may be still output.

The latch employed in the present disclosure is described with reference to a specific embodiment, wherein one of the most commonly used latches is an SR-type latch.

Figure 11:
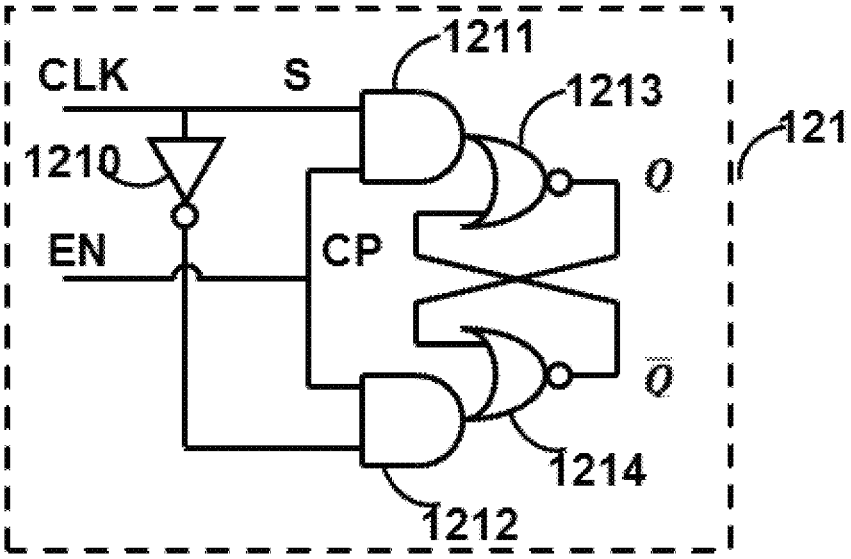
FIG. 11 is a circuit principle diagram of a latch according to an embodiment of the present disclosure.

As illustrated in FIG. 11, in this embodiment, the latch includes: a latch inverter 1210, a first AND gate 1211, a second AND gate 1212, a first NOR gate 1213, and a second NOR gate 1214.

An input terminal of the latch inverter 1210 and a first input terminal of the first AND gate 1211 are collectively connected to the second clock signal (CLK), an output terminal of the latch inverter 1210 is connected to a second input terminal of the second AND gate 1212, and a second input terminal of the first AND gate 1211 and a first input terminal of the second AND gate 1212 are collectively connected to the enable signal output terminal of the enable module. An output terminal of the first AND gate 1211 is connected to a first input terminal of a first NOR gate 1213, a second input terminal of the first NOR gate 1213 is connected to a first input terminal of the second NOR gate 1214, and an output terminal of the first NOR gate 1213 is further connected to the input terminal of the buffer amplifier circuit 122. A second input terminal of the second NOR gate 1214 is connected to an output terminal of the second AND gate 1212.

The first input terminal of the first AND gate 1211 is the first terminal of the latch circuit 121, a connecting terminal between the second input terminal of the first AND gate 1211 and the first input terminal of the second AND gate 1212 is the second terminal of the latch circuit 121, and the output terminal of the first NOR gate 1213 is the third terminal of the latch circuit 121.

Further, the inverters employed in the buffer amplifier circuit are all formed of transistors.

Figure 12:
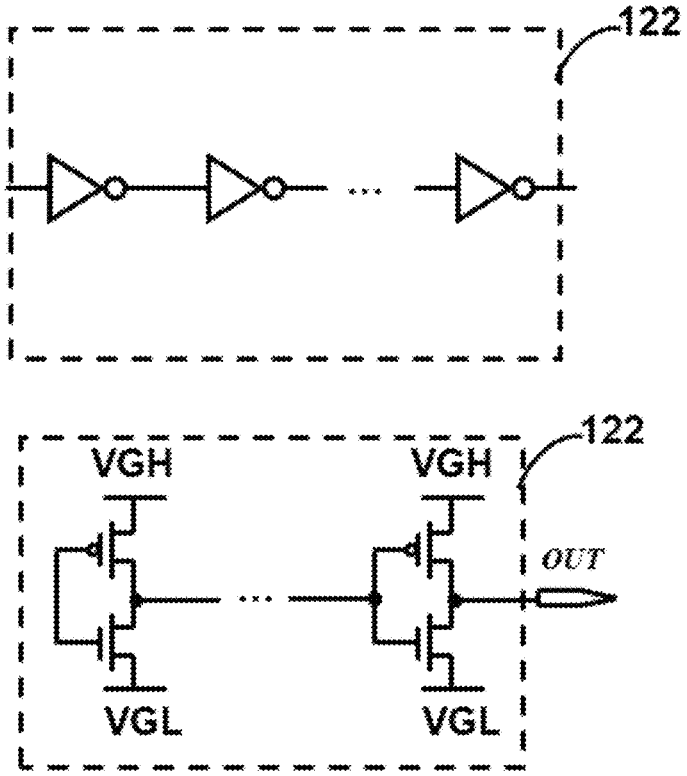
FIG. 12 is a circuit principle diagram of a buffer inverter according to an embodiment of the present disclosure.

Specifically, as illustrated in FIG. 12, each inverter may include a P-type transistor and an N-type transistor.

Specifically, a first electrode of the P-type transistor is connected to a constant high voltage level (VGH), a second electrode of the P-type transistor is connected to a first electrode of the N-type transistor, a second electrode of the N-type transistor is connected to a constant low voltage level (VGL), a gate of the P-type transistor is connected to a gate of the N-type transistor, and the second electrode of the P-type transistor is connected to a first electrode of the N-type transistor.

A connecting terminal between the gate of the P-type transistor and the gate of the N-type transistor is the input terminal of the inverter, and a connecting terminal between the second electrode of the P-type transistor and the first electrode of the N-type transistor is the output terminal of the inverter.

It should be noted that in the embodiment of the present disclosure, a P-type transistor in each of the plurality of GOA units 10 is a P-channel thin film transistor made of low-temperature polysilicon, amorphous silicon, or a material resulted from a mixture of carbon, silicon, and germanium at any ratio. An N-type transistor in each of the plurality of GOA units 10 is an N-channel thin film transistor made of metal oxide. In addition, the GOA circuit according to the present disclosure is a GOA circuit based on polarity complementary transistors. That is, an N-type transistor and a P-type transistor are simultaneously disposed on a panel.

Figure 13A:
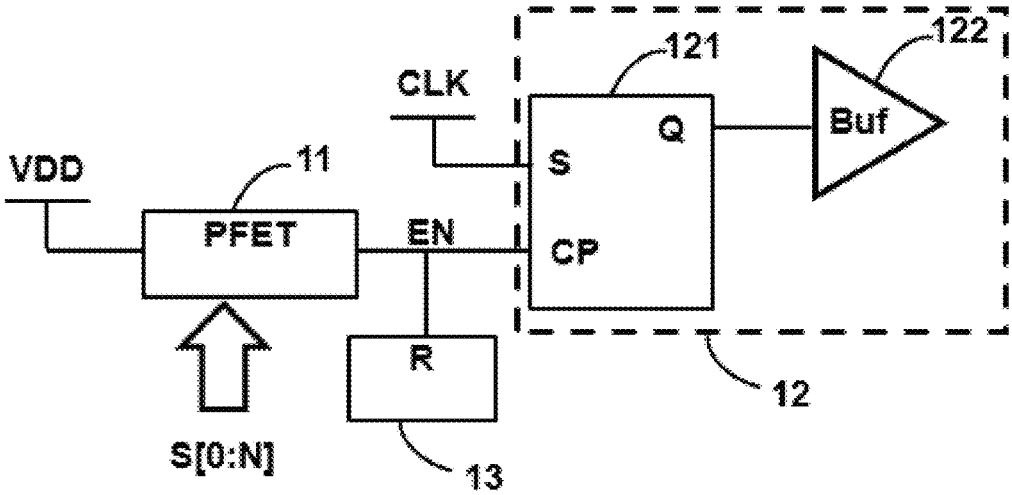
FIG. 13*a* is a circuit principle diagram of a single GOA unit employing a P-type transistor as a decoder.

Referring to FIG. 13*a* and FIG. 13*b*, a circuit principle diagram of a single GOA unit 10 employing a P-type transistor as a decoder, and a circuit principle diagram of a single GOA unit 10 employing an N-type transistor as a decoder according to an embodiment of the present disclosure are illustrated.

As illustrated in FIG. 13*a* and FIG. 13*b*, VSS represents an input direct current low level, VDD represents an input direct current high level, S [0:N) represents an input address signal, CLK represents an input clock signal, and EN represents an internal enable node of the GOA unit 10. NFET represents a row decoder constituted by the N-type transistor, PFET represents a row decoder constituted by the P-type transistor, R represents the reset module 13, 121 represents the latch circuit, and Buf represents the buffer amplifier circuit 122.

Referring to FIG. 14*a* and FIG. 14*b*, FIG. 14*a* schematically illustrates a circuit principle diagram of a decoder constituted by the P-type transistor wherein the reset module 13 employs the single GOA unit 10 according to the first embodiment as illustrated in FIG. 8. In this embodiment, a 4-bit address is used as an example, and the latch circuit 121 includes a latch.

As illustrated in FIG. 14*b*, CLK1 to CLK4 may be all supplied by the drive IC, which are constantly supplied after the screen is turned on and comes into display; S[0:N] represents a row address signal input to the row decoder, and Dn−2, Dn−1, Dn, Dn+1, and Dn+2 represent row address signals in different time periods of the row address signal S[0:N] input to the row decoder.

Time period t1: Address decoding is carried out in this period, the row decoder in a stage of GOA unit 10 corresponding to the row address signal Dn in S[0:N] is selected, the enable signal output by the enable signal output terminal (EN) of the row decoder of this row is a high level, and since the first clock signal (CLKR) is a low level, the reset transistor in the reset module 13 is turned off, such that the output of the enable signal is not affected; when a rising edge of the second clock signal (CLK) comes, the latch stores a high level signal input by the input terminal (S) and transmits the high level signal to the output terminal (Q) which outputs the high level signal to the buffer amplifier circuit 122, and the buffer amplifier circuit 122 processes the signal and outputs the processed signal to the gate line of the corresponding row.

Time period t2: The enable node (EN) still outputs a high level, the reset transistor in the reset module 13 is still turned off, and the voltage of the second clock signal (CLK) falls, which causes the voltage of the output terminal (OUT) to fall.

Time period t3: A rising edge of the first clock signal (CLKR) comes, which is a high level, the reset transistor in the reset module 13 is turned on, such that the enable node (EN) is pulled down to a low level (GND), that is, the row decoder is reset. The enable terminal (CP) of the latch becomes to a low level, and therefore, the output thereof does not vary with variation of the input terminal (S), but remains a low level.

Time period t4: EN is not selected, the second clock signal (CLK) is still a low level, the enable input terminal (CP) of the latch remains a low level, the output thereof does not vary with variation of the input terminal (S) but remains a low level, the reset transistor in the reset module 13 is still a low level, and the reset transistor in the reset module 13 is turned off.

Figure 15:
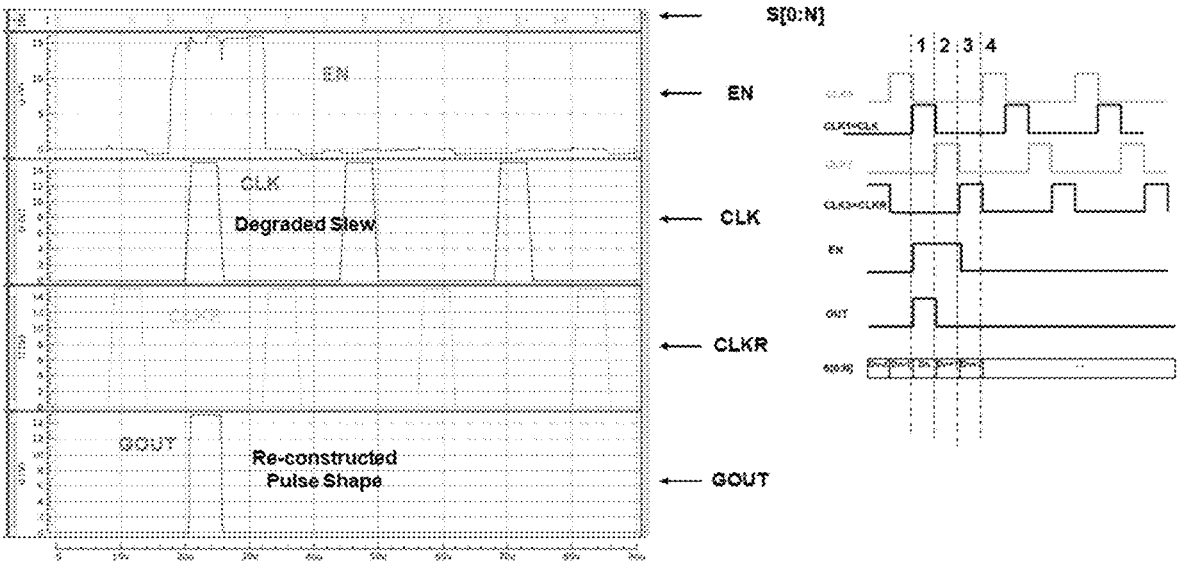
FIG. 15 is a simulation verification diagram of the operating timing in FIG. 14*a;*
Figure 16:
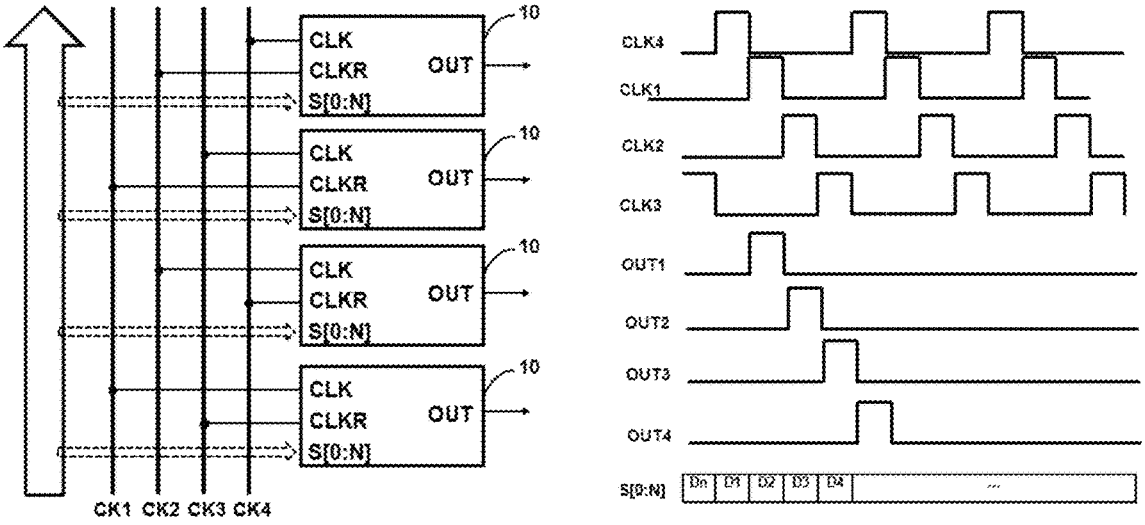
FIG. 16 is a schematic diagram of a full-screen GOA circuit employing the circuit in FIG. 14*a;*

FIG. 15 is a simulation verification diagram of an operating timing of FIG. 14*a*. As seen from FIG. 15, a simulation result is equivalent to an operating timing result. FIG. 16 schematically illustrates a full-screen GOA circuit employing a plurality of GOA units as illustrated in FIG. 14. As seen from FIG. 16, in each stage of GOA unit 10, different from the traditional GOA circuit, an output of each stage of GOA unit 10 only enters a pixel array, but does not enter any previous or subsequent stage of GOA unit 10. To be specific, operating of any stage of GOA unit 10 in the present disclosure does not rely on the enable signal supplied by a previous or a subsequent stage of GOA unit, and the row decoder at the local stage generates the enable signal.

Figure 17:
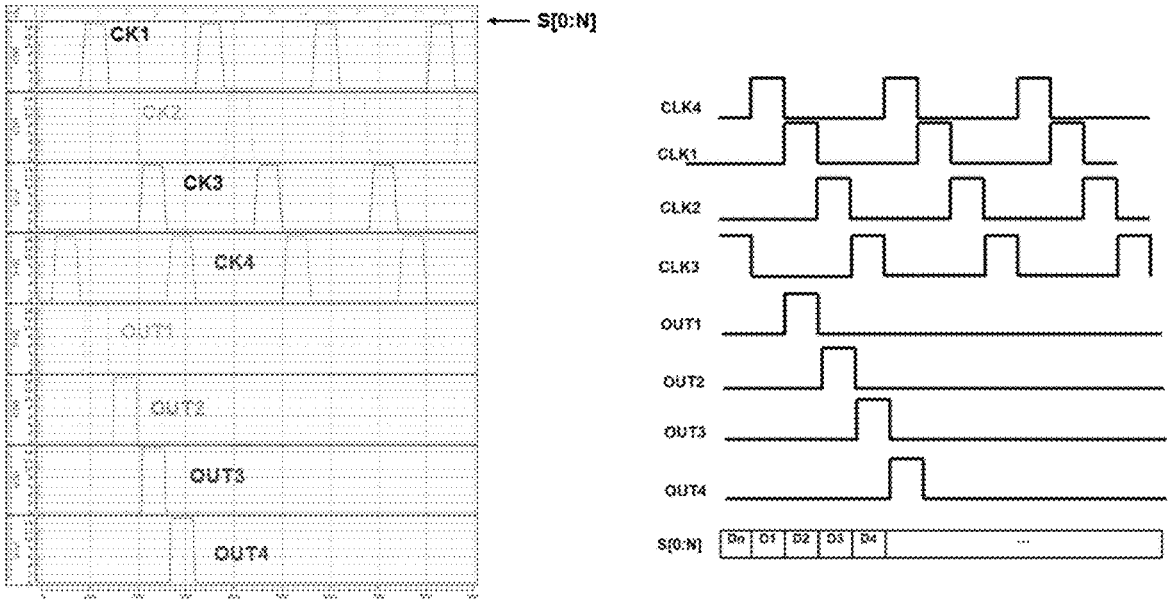
FIG. 17 is a simulation verification diagram of an operating timing of a plurality of stages of cascaded GOA units employing the circuit in FIG. 16.

FIG. 17 is a simulation verification diagram of an operating timing of a plurality of stages of cascaded GOA units in FIG. 16.

Figure 18:
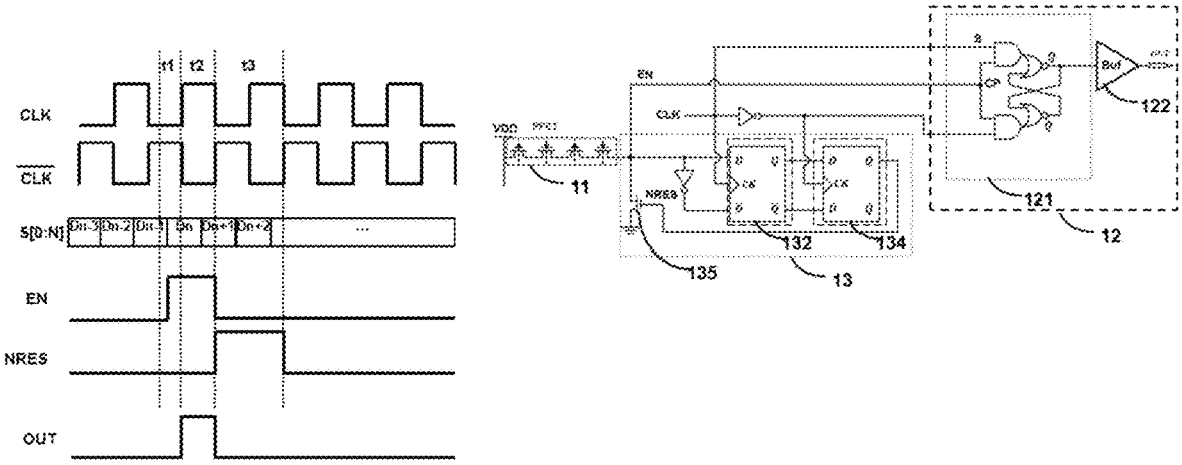
FIG. 18 is a circuit principle diagram and an operating timing of a reset module employing a single GOA unit according to the second embodiment.

Referring to FIG. 18, a circuit principle diagram and an operating timing of the reset module employing the single GOA unit 10 according to the second embodiment as illustrated in FIG. 9 are illustrated. In this embodiment, the reset module 13 includes a pull-down transistor 135, a first-stage positive edge flip-flop 132, and a second-stage positive edge flip-flop 134; and the latch circuit 121 includes a latch.

As illustrated in FIG. 18, the CLK is supplied by the drive IC; S[0:N] represents a row address signal input to the row decoder, and Dn−3, Dn−2, Dn−1, Dn, Dn+1, and Dn+2 represent row address signals in different time periods of the row address signal S[0:N] input to the row decoder.

Time period t1: Address decoding is carried out in this period, the row decoder in a stage of GOA unit 10 corresponding to the row address signal Dn is selected, the enable signal output by the enable signal output terminal (EN) of the row decoder of this row is a high level, and since the reset signal (NRES) is a low level, the pull-down transistor 135 is turned off, which does not affect the output of the enable signal.

Time period t2: A pulse of the second clock signal (CLK) comes, the latch in the latch circuit 121 stores a pulse signal input by the input terminal (S) and transmits the pulse signal to the output terminal (Q) which outputs the signal to the buffer amplifier circuit 122. In the meantime, at a rising edge of the clock signal, the first-stage positive edge flip-flop 132 latches the EN high level, and outputs the EN high level to the output terminal of the first-stage positive edge flip-flop 132. At a subsequently coming falling edge of the clock signal, the second-stage positive edge flip-flop 134 latches a high level output by the first-stage positive flip-flop 132, and transmits the high level to the output terminal of the second-stage positive edge flip-flop 134, which outputs the high level to the gate (NRES) of the pull-down transistor 135.

Time period t3: Since the reset signal (NRES) rises, the pull-down transistor 135 is turned on, the enable signal output terminal (EN) of the row decoder is reset to a low level, and the latch in the latch circuit 121 is turned off Afterwards, before the decoder is selected again, the enable signal output terminal (EN) of the row decoder constantly outputs a low level, the latch in the latch circuit 121 remains in a turn-off state, and the output thereof remains a low level.

Figure 19:
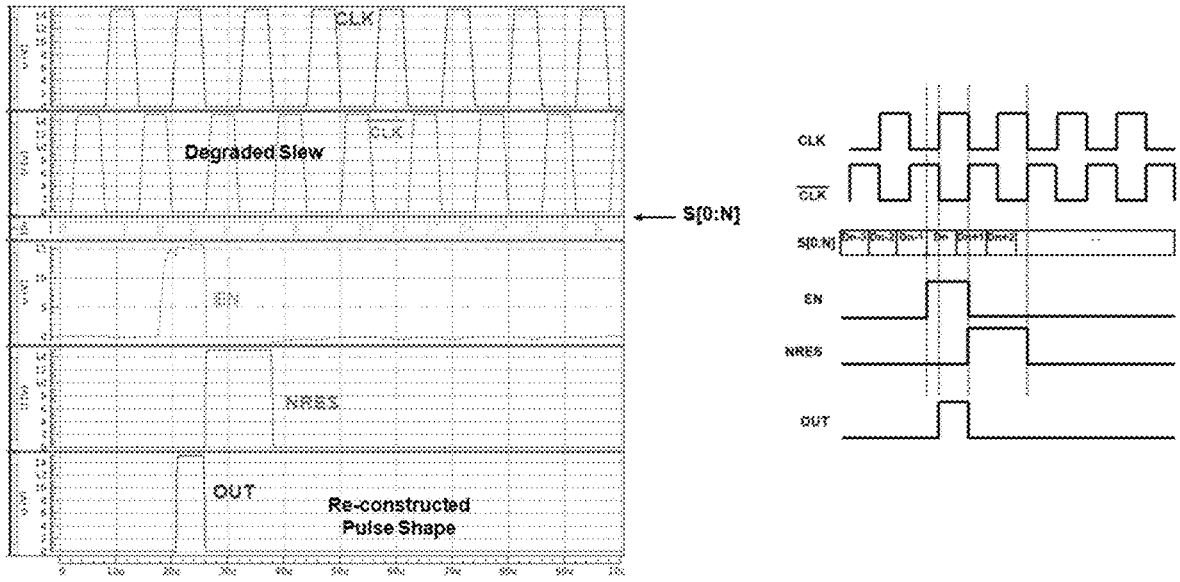
FIG. 19 is a simulation verification diagram of an operating timing of the circuit in FIG. 18.
Figure 20:
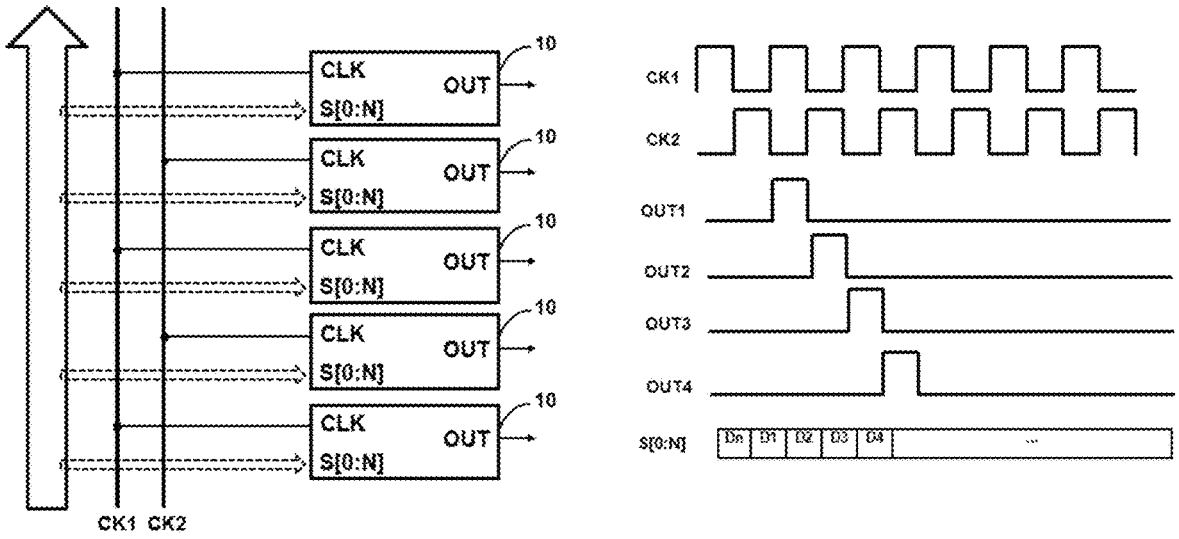
FIG. 20 is a schematic diagram of a full-screen GOA circuit employing the circuit in FIG. 18.
Figure 21:
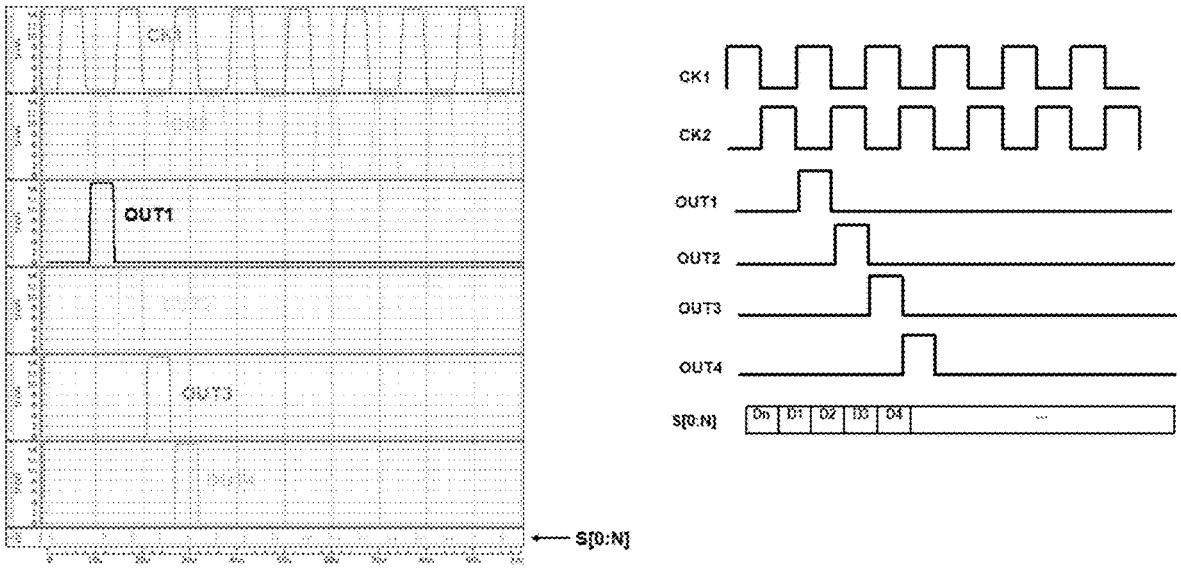
FIG. 21 illustrates an operating timing diagram and a simulation verification diagram of the operating timing of the GOA circuit in FIG. 20.

The simulation verification diagram of the operating timing in FIG. 18 is as illustrated in FIG. 19. As illustrated in FIG. 19, the simulation result is equivalent to the operating timing result. A schematic diagram of a full-screen GOA circuit employing the circuit as illustrated in FIG. 18 is as illustrated in FIG. 20. A simulation verification diagram of the operating timing thereof is as illustrated in FIG. 21.

According to the embodiments of the present disclosure, by introducing the latch into each GOA unit 10, the internal alternating current signals or glitch signals in the circuit may be effectively suppressed from being coupled to the output terminal, and the waveform reconstruction function is achieved. Even if the waveform of the external clock is deformed due to the RC delay, a high-quality square wave pulse may be still output. In some embodiments, the GOA circuit may generate a reset signal by itself (self-reset), without relying on the external clock. Therefore, the number of desired clocks is reduced, and only two square wave clocks with inverted phases are desired at minimum. The ratio of rows randomly programmable at any time is increased, which may reach 1/2 of the total rows at maximum. This is particularly suitable for circuit design of high-resolution and variable-dimension screens.

In addition, the GOA circuit according to the embodiments of the present disclosure is also applicable to a foldable or rollable screen. With respect to the foldable or rollable screen, the GOA circuit allows a folded or rolled portion not to display images, and thus no power consumption is caused. Further, the GOA circuit allows dynamic adjusting a boundary line between a display region and a non-display region.

Figure 22:
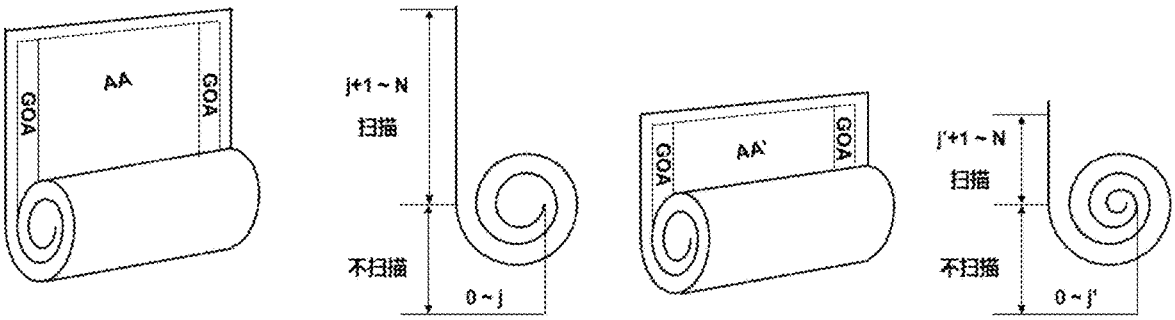
FIG. 22 is a schematic diagram of a layout of the GOA circuit according to the embodiment of the present disclosure in a rollable display screen.
Figure 23:
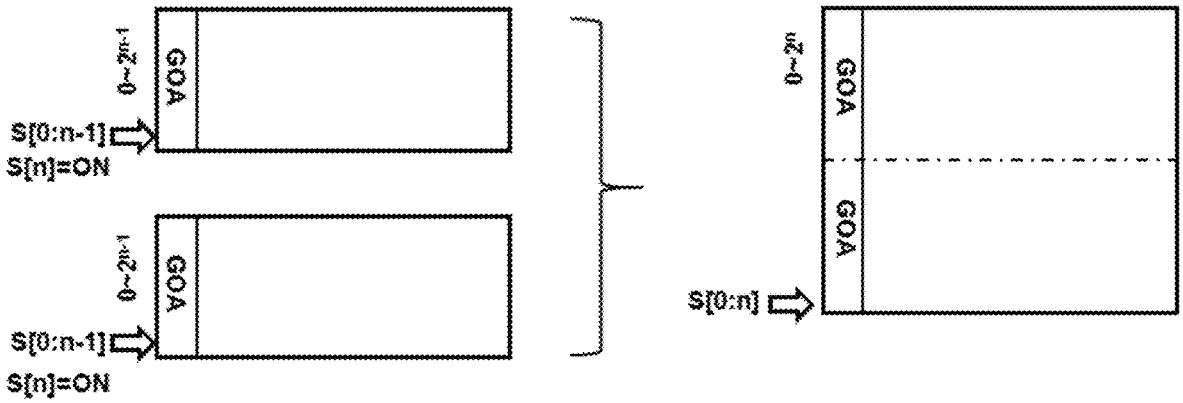
FIG. 23 is a schematic diagram of a layout of the GOA circuit according to the embodiment of the present disclosure in a spliced screen.

Layouts of the GOA circuit on the screen according to the embodiments of the present disclosure with respect to the rollable, foldable, and splicable screens are as illustrated in FIG. 22 and FIG. 23.

As illustrated in FIG. 22, by employing the GOA circuit according to the present disclosure, in a rollable flexible display screen, the portion that is to display images only needs to be scanned, that is, signals are transmitted to an address range of the $(j+1)^{th}$ row to the $N^{th}$ row of the GOA circuit, the rolled portion (the portion suffering a mechanical stress) may be input with black signals when a first frame image is transmitted, and may not be scanned hereinafter. In this way, power consumption is reduced, and service life is prolonged. When the screen is extended and contracted, by dynamically adjusting the address range for transmitting signals to the GOA circuit, the portion to be scanned and the portion not to be scanned are changed, thereby dynamically reducing the power consumption.

As illustrated in FIG. 23, the GOA circuit according to the embodiments of the present disclosure is applicable to a seamlessly spliced display screen. In the seamlessly spliced display screen, during manufacturing of each display screen to be spliced, an upper address is reserved in a decoder and a redundant address line is reserved. When a single screen is operating, undesired upper address lines are set to a full-on level, such that it is ensured that upper transistors of all the row decoders are all turned on. In this case, lower ones only need to be scanned. When a plurality of screens are being spliced, the GOA portions are directly electrically bridged at the joint, the address line, the clock line, and the power line are shorted, and even upper addresses are enabled.

As a solution, the present disclosure provides a latch-based GOA circuit supporting random addressing. The GOA circuit allows data to be written into the screen not in accordance with rows. A majority region of the screen displays static images and only a small portion of the screen is constantly varying, and only this portion needs to be programmed. In addition, since the rows with static images are not gated, and thus dynamic power consumption is effectively reduced and meanwhile the time left for each row with varying images, such that real-time and dynamic adjustment may be achieved between display size, display power and display refresh rate.

Further, in the GOA circuit according to the present disclosure, trigger of a later stage does not rely on trigger of a previous stage. Therefore, when a separated-stage GOA unit 10 fails, functions of the remaining GOA units 10 are not affected, such that yield and rating of the screen are improved, thereby providing possibilities of dynamic repair of the screen. In addition, the GOA circuit according to the present disclosure does not employ a traditional bootstrap structure. A clock line does not need to directly drive an output transistor in the GOA unit. Therefore, impacts caused by (N−1) stages of inactive GOA units to the dynamic power consumption may be greatly mitigated.

Therefore, the GOA circuit according to the present disclosure is applicable to high resolution and large-size screens.

According to the embodiments of the present disclosure, by introducing the latch into each GOA unit, the internal alternating current signals or glitch signals in the circuit may be effectively suppressed from being coupled to the output terminal, and the waveform reconstruction function is achieved. Even if the waveform of the external clock is deformed due to the RC delay, a high-quality square wave pulse may be still output. In some embodiments, the GOA circuit may generate a reset signal by itself (self-reset), without relying on the external clock. Therefore, the number of desired clocks is reduced, and only two square wave clocks with inverted phases are desired at minimum. The ratio of rows randomly programmable at any time is increased, which may reach 1/2 of the total rows at maximum. This is particularly suitable for circuit design of high-resolution and variable-dimension screens.

In addition, the GOA circuit according to the embodiments of the present disclosure is also applicable to a foldable or rollable screen. With respect to the foldable or rollable screen, the GOA circuit allows a folded or rolled portion not to display images, and thus no power consumption is caused. Further, the GOA circuit allows dynamic adjusting a boundary line between a display region and a non-display region.

Further, the present disclosure further provides a display device. The display device includes the GOA circuit as described in the above embodiment. The display device includes, but is not limited to, an LTPS display device and an AMOLED display device.

Figure 24:
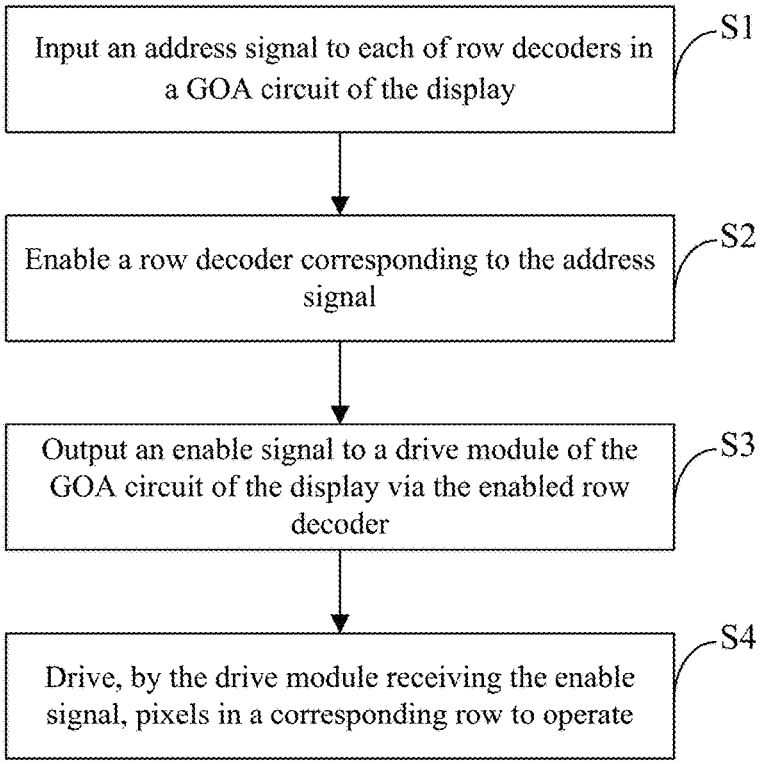
FIG. 24 is a schematic flowchart of a method for controlling a display according to an embodiment of the present disclosure.

The present disclosure further provides a method for controlling a display. As illustrated in FIG. 24, the method may include the following steps:

step S1, inputting an address signal to each of row decoders in a GOA circuit of the display;

step S2, enabling a row decoder corresponding to the address signal;

step S3, outputting an enable signal to a drive module of the GOA circuit of the display via the enabled row decoder; and step S4, driving, by the drive module receiving the enable signal, pixels in a corresponding row to operate In the method according to the embodiment of the present disclosure, the GOA circuit of the display may be the GOA circuit as described in the above embodiment.

Further, the method according to the embodiment of the present disclosure further includes: maintaining a row decoder not corresponding to the address signal disabled in response to enabling the row decoder corresponding to the address signal.

Further, the method according to the embodiment of the present disclosure further includes: selectively enabling a portion of the row decoders based on the address signal.

Optionally, in the embodiment of the present disclosure, the drive module includes a latch, wherein the latch is configured to receive the enable signal.

Further, the method according to the embodiment of the present disclosure further includes: inputting a second clock signal to the latch; and reconstructing, by the latch, a waveform of the second clock signal based on the enable signal, and outputting the waveform.

Further, in the embodiment of the present disclosure, the drive module further includes an amplifier, wherein a signal output by the latch is amplified by the amplifier and drives the pixels in the corresponding row to operate.

Further, the method according to the embodiment of the present disclosure further includes: resetting the enable signal output by the enabled row decoder. Further, resetting the enable signal output by the enabled row decoder may be performed by the reset circuit.

Further, the method according to the embodiment of the present disclosure further includes: inputting a first clock signal to the reset circuit; and resetting, by the reset circuit, the enable signal based on the first clock signal.

Further, the method according to the embodiment of the present disclosure further includes: inputting a second clock signal to the reset circuit; and resetting, by the reset circuit, the enable signal based on the second clock signal.

The above embodiments are merely given for illustration of the technical concepts and characteristics of the present disclosure, and are intended to better help persons skilled in the art to understand the content of the present disclosure and practice the technical solutions according to the present disclosure. However, these embodiments are not intended to limit the protection scope of the present disclosure. Any equivalent modifications and polishments made within the protection scope of the appended claims shall be all within the protection scope subject to the appended claims.

It should be understood that persons of ordinary skill in the art may derive improvements or variations according to the above description, and such improvements or variations shall all fall within the protection scope as defined by the claims of the present disclosure.

What is claimed is:

1. A gate driver on array (GOA) circuit, comprising a plurality of GOA units independent of each other, wherein each of the plurality of GOA units comprises an enable module and a drive module disposed corresponding to the enable module; wherein the enable module comprises a row address signal input terminal configured to receive a row address signal, and an enable signal output terminal configured to output an enable signal based on the row address signal; and the drive module comprises an enable signal input terminal configured to receive the enable signal output by the enable signal output terminal, and a drive signal output terminal configured to output a drive signal based on the enable signal, wherein the drive signal output terminal is connected to a gate line of a row disposed corresponding to the drive module to transmit the drive signal to the gate line of the row and drive the row;

wherein the enable module is a row decoder based on binary coding or a row decoder based on Gray coding; and wherein the drive module comprises a latch circuit, a data input terminal of the latch circuit is connected to a second clock signal, a clock input terminal of the latch circuit is connected to the enable signal output terminal of the enable module, and an output terminal of the latch circuit acts as the drive signal output terminal of the drive module and is connected to the gate line of the row disposed corresponding to the drive module.

2. The GOA circuit according to claim 1, wherein each row decoder comprises a plurality of transistors connected in series, two transistors in adjacent rows and in a same column being combined to a transistor when satisfying a preset condition.

3. The GOA circuit according to claim 2, wherein the two transistors in adjacent rows and in the same column satisfying the preset condition comprises:

gates of the two transistors being shorted together, and each of the two transistors being an uppermost transistor in the row decoder; or gates of the two transistors being shorted together, and upper transistors adjacent to the two transistors having been combined.

4. The GOA circuit according to claim 1, wherein each of the plurality of GOA units further comprises a reset module connected to the enable signal output terminal of the enable module and configured to reset the enable module in response to the drive module outputting the drive signal and gating the corresponding row, wherein the reset module comprises a reset transistor; and wherein a first electrode of the reset transistor is connected to the enable signal output terminal of the enable module, a second electrode of the reset transistor is connected to a ground signal, and a gate of the reset transistor is connected to a first clock signal.

5. The GOA circuit according to claim 1, wherein each of the plurality of GOA units further comprises a reset module connected to the enable signal output terminal of the enable module and configured to reset the enable module in response to the drive module outputting the drive signal and gating the corresponding row, wherein the reset module comprises a pull-down transistor, a first-stage positive edge flip-flop, a first-stage inverter, a second-stage positive edge flip-flop, and a second-stage inverter; wherein a non-inverting input terminal of the first-stage positive edge flip-flop and an input terminal of the first-stage inverter are collectively connected to the enable signal output terminal of the enable module, an inverting input terminal of the first-stage positive edge flip-flop is connected to an output terminal of the first-stage inverter, and both a clock signal input terminal of the first-stage positive edge flip-flop and an input terminal of the second-stage inverter are collectively connected to a second clock signal; wherein a non-inverting input terminal of the second-stage positive edge flip-flop is connected to a non-inverting output terminal of the first-stage positive edge flip-flop, an inverting input terminal of the second-stage positive edge flip-flop is connected to an inverting output terminal of the first-stage positive edge flip-flop, a clock signal input terminal of the second-stage positive edge flip-flop is connected to an output terminal of the second inverter, and a non-inverting output terminal of the second-stage positive edge flip-flop is connected to a gate of the pull-down transistor; and a first electrode of the pull-down transistor is connected to the enable signal output terminal of the enable module, and a second electrode of the pull-down transistor is connected to a ground signal.

6. The GOA circuit according to claim 1, wherein the drive module further comprises a buffer amplifier circuit; and wherein an input terminal of the buffer amplifier circuit is connected to the output terminal of the latch circuit, and an output terminal of the buffer amplifier circuit acts as the drive signal output terminal of the drive module and is connected to the gate line of the row disposed corresponding to the drive module.

7. The GOA circuit according to claim 1, wherein a P-type transistor in each of the plurality of GOA units is a P-channel thin film transistor made of low-temperature polysilicon, amorphous silicon, or a material resulted from a mixture of carbon, silicon, and germanium at any ratio.

8. The GOA circuit according to claim 1, wherein an N-type transistor in each of the plurality of GOA units is an N-channel thin film transistor made of metal oxide.

9. A display device, comprising a GOA circuit wherein the GOA circuit comprises:

a plurality of GOA units independent of each other, wherein each of the plurality of GOA units comprises an enable module and a drive module disposed corresponding to the enable module; wherein the enable module comprises a row address signal input terminal configured to receive a row address signal, and an enable signal output terminal configured to output an enable signal based on the row address signal; and the drive module comprises an enable signal input terminal configured to receive the enable signal output by the enable signal output terminal, and a drive signal output terminal configured to output a drive signal based on the enable signal, wherein the drive signal output terminal is connected to a gate line of a row disposed corresponding to the drive module to transmit the drive signal to the gate line of the row and drive the row;

wherein the enable module is a row decoder based on binary coding or a row decoder based on Gray coding; and wherein the drive module comprises a latch circuit, a data input terminal of the latch circuit is connected to a second clock signal, a clock input terminal of the latch circuit is connected to the enable signal output terminal of the enable module, and an output terminal of the latch circuit acts as the drive signal output terminal of the drive module and is connected to the gate line of the row disposed corresponding to the drive module.

10. A method for controlling a display, comprising:

inputting an address signal to each of row decoders in a gate driver on array (GOA) circuit of the display;

enabling a row decoder corresponding to the address signal;

outputting an enable signal to a drive module of the GOA circuit of the display via the enabled row decoder; and driving, by the drive module receiving the enable signal, pixels in a corresponding row to operate;

wherein the drive module comprises a latch, the latch being configured to receive the enable signal, and the method further comprises:

inputting a second clock signal to the latch; and reconstructing, by the latch, a waveform of the second clock signal based on the enable signal, and outputting the waveform.

11. The method according to claim 10, further comprising:

maintaining a row decoder not corresponding to the address signal disabled in response to enabling the row decoder corresponding to the address signal.

12. The method according to claim 10, further comprising:

selectively enabling a portion of the row decoders based on the address signal.

13. The method according to claim 10, wherein the drive module further comprises an amplifier, a signal output by the latch being amplified by the amplifier and driving the pixels in the corresponding row to operate.

14. The method according to claim 10, further comprising:

resetting the enable signal output by the enabled row decoder.

15. The method according to claim 14, wherein the enable signal output by the enabled row decoder is reset by a reset circuit.

* * * * *